US008123097B2

(12) United States Patent
Haramiishi et al.

(10) Patent No.: US 8,123,097 B2
(45) Date of Patent: Feb. 28, 2012

(54) SELF -PROPELLED STAPLER

(75) Inventors: Kiichi Haramiishi, Tokyo (JP); Katsunori Manabe, Tokyo (JP)

(73) Assignee: Max Co., Ltd., Tokyo (JP)

( * ) Notice: Subject to any disclaimer, the term of this patent is extended or adjusted under 35 U.S.C. 154(b) by 501 days.

(21) Appl. No.: 11/547,670

(22) PCT Filed: Apr. 7, 2005

(86) PCT No.: PCT/JP2005/006877

§ 371 (c)(1),
(2), (4) Date: Jul. 9, 2008

(87) PCT Pub. No.: WO2005/097440

PCT Pub. Date: Oct. 20, 2005

(65) Prior Publication Data

US 2008/0272167 A1 Nov. 6, 2008

(30) Foreign Application Priority Data

Apr. 9, 2004 (JP) ..... P. 2004-115932

(51) Int. Cl.
*B25C 5/15* (2006.01)

(52) U.S. Cl. ..... 227/131; 227/100

(58) Field of Classification Search ..... 227/100, 227/110, 111, 131, 148; 270/37
See application file for complete search history.

(56) References Cited

U.S. PATENT DOCUMENTS

| | | | | |
|---|---|---|---|---|
| 5,092,509 | A * | 3/1992 | Naito et al. | 227/99 |
| 5,290,020 | A * | 3/1994 | Matsui et al. | 270/58.19 |
| 5,842,624 | A * | 12/1998 | Ishida | 227/111 |
| 6,092,712 | A * | 7/2000 | Rueckl | 227/111 |
| 6,164,511 | A * | 12/2000 | Chung et al. | 227/148 |
| 7,063,248 | B2 * | 6/2006 | Noh et al. | 227/111 |

FOREIGN PATENT DOCUMENTS

| | | |
|---|---|---|
| JP | 2-56367 | 2/1990 |
| JP | 4-16392 A | 1/1992 |
| JP | 4-72271 | 3/1992 |
| JP | 8-101551 A | 4/1996 |
| JP | 9-295749 | 11/1997 |
| JP | 2001-206629 | 7/2001 |

* cited by examiner

*Primary Examiner* — Lindsay Low
*Assistant Examiner* — Nathaniel Chukwurah
(74) *Attorney, Agent, or Firm* — Morgan, Lewis Bockius LLP

(57) ABSTRACT

A self-propelled stapler has a stapler body provided on a base in such so as to be slidable relative to the base. A sliding mechanism is provided between the base and the stapler body. The stapler body slides to a predetermined binding position at the time of a binding operation, and slides to an original position after the binding operation by the sliding mechanism. The sliding mechanism has a link which is rotatably provided on each side of the stapler body, and one end of the link engages with the base.

4 Claims, 6 Drawing Sheets

SELF -PROPELLED STAPLER

TECHNICAL FIELD

The present invention relates to a self-propelled stapler having a stapler body which is slidably provided on a base.

BACKGROUND ART

Generally, an image processing machine such as a copying machine, a facsimile machine or their combination mounting a stapler is known.

Meanwhile, when binding a bunch of papers with a staple, operations for feeding the papers to a binding portion of a stapler, carrying out a binding operation with the stapler thereafter, and retracting the bunch of stapled papers from the binding portion after completion of the binding operation, are necessary.

JP-A-09-295749 discloses an image processing apparatus, such as a copying machine or a facsimile machine, in which a paper conveying device having a paper grasping/releasing mechanism and a paper insertion/retraction mechanism is installed, thereby grasping the bunch of papers, conveying the bunch of papers to a binding portion of a stapler, releasing the bunch of stapled papers, and retracting the bunch of stapled papers after completion of a binding operation.

However, when mounting such paper conveying device as described above in an image processing machine, it is necessary to provide mechanisms for grasping/releasing and inserting/retracting the bunch of papers. Therefore, the processing machine itself becomes complicated, resulting in an increase in size as well as in cost, thereby causing an impediment in mounting a stapler on a small-size and low-cost image processing machine.

DISCLOSURE OF THE INVENTION

In order to solve the problem described above, an embodiment of the invention provides an self-propelled stapler which enables a reduction in size and cost in an image processing machine equipped with a paper conveying device, and also capable of being mounted on an image processing machine equipped with no special apparatus for conveying papers.

The self-propelled stapler according to the embodiment of the invention is a stapler which is mounted on an image processing machine for applying a binding to a bunch of papers inside it, and is an self-propelled stapler in which a stapler body is provided on a base in such a way as to be slidable relative to it, a sliding mechanism is provided between the base and the stapler body, and the base is fixed to the image processing machine, and also in which the sliding mechanism causes the stapler body to slide to a prescribed binding position at the time of a binding operation, and to slide to an original position after finishing the binding operation, being characterized in that the slide mechanism is configured in such a way that one end of a link rotatably provided on each side of the stapler body is provided in such a way as to be able to engage with the base.

The other features and advantageous effects are obvious from the description of the embodiment and the attached claims.

DESCRIPTION OF REFERENCE NUMERALS AND SIGNS

1 Stapler body
2 Base
5 Sliding mechanism
7 L-shaped link

BEST MODE FOR CARRYING OUT THE INVENTION

An embodiment of the invention will hereafter be described in accordance with the drawings.

Figure 1:
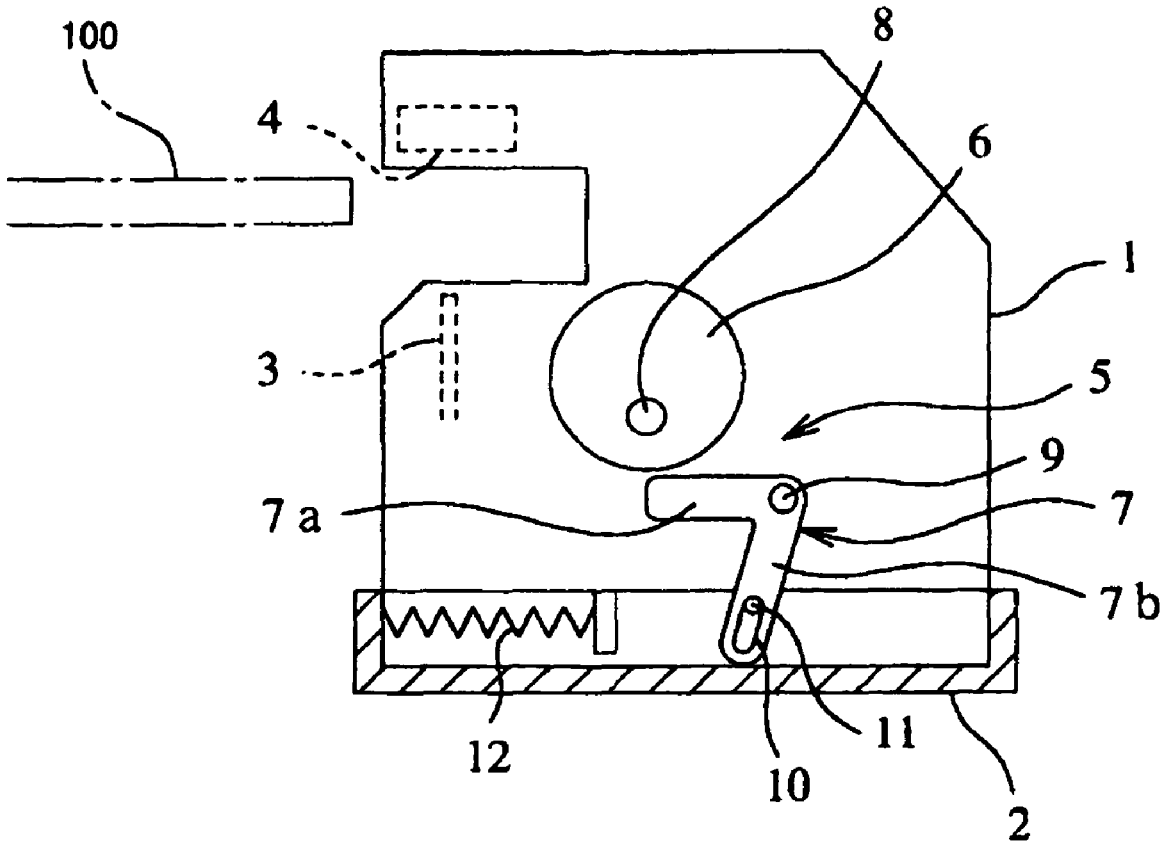
[FIG. 1] It is a schematic side view of a stapler according to the embodiment.

FIG. 1 is a schematic view of a self-propelled stapler according to the embodiment, wherein a reference numeral 1 indicates a stapler body and a reference numeral 2 indicates a base.

The base 2 is formed into a board shape having approximately the same size as a bottom surface of the stapler body 1.

The stapler body 1 is slidably provided with respect to the base 2. The stapler is a binding apparatus having staple driving means 3 which drives a staple to penetrate through a bunch of papers 100 to be bound and clinching means 4 which bends the protruding legs of the staple, and employs an electric motor as a driving source. However, not only a case in which the stapler body 1 is provided with the stapler driving means and the clinching means, but also a case in which only one of the driving means and the clinching means is provided to the stapler body 1 while the other of the driving means and the clinching means is provided to an image processing machine is included herein.

A sliding mechanism 5 is provided between the base 2 and the stapler body 1. That is, an eccentric cam 6 and an L-shaped link 7 are disposed on each side of the stapler body 1. The eccentric cam 6, having a rotary shaft 8 provided at an eccentric position of a disk, is operated in conjunction with a driving mechanism (not shown) inside the stapler body 1. A bent portion of each of the L-shaped links 7 is rotatably supported by a support shaft 9 provided on each side of the stapler body 1, and one portion 7*a* is disposed so as to be engagable with the eccentric cam 6. An elongated hole 10 is formed on the other portion 7*b*.

The base 2 is provided with a shaft 11 which engages with the elongated hole 10 formed on the other end portion of each of the L-shaped links 7. Further, a compression spring 12 is provided between the base 2 and the stapler body 1.

Figure 2:
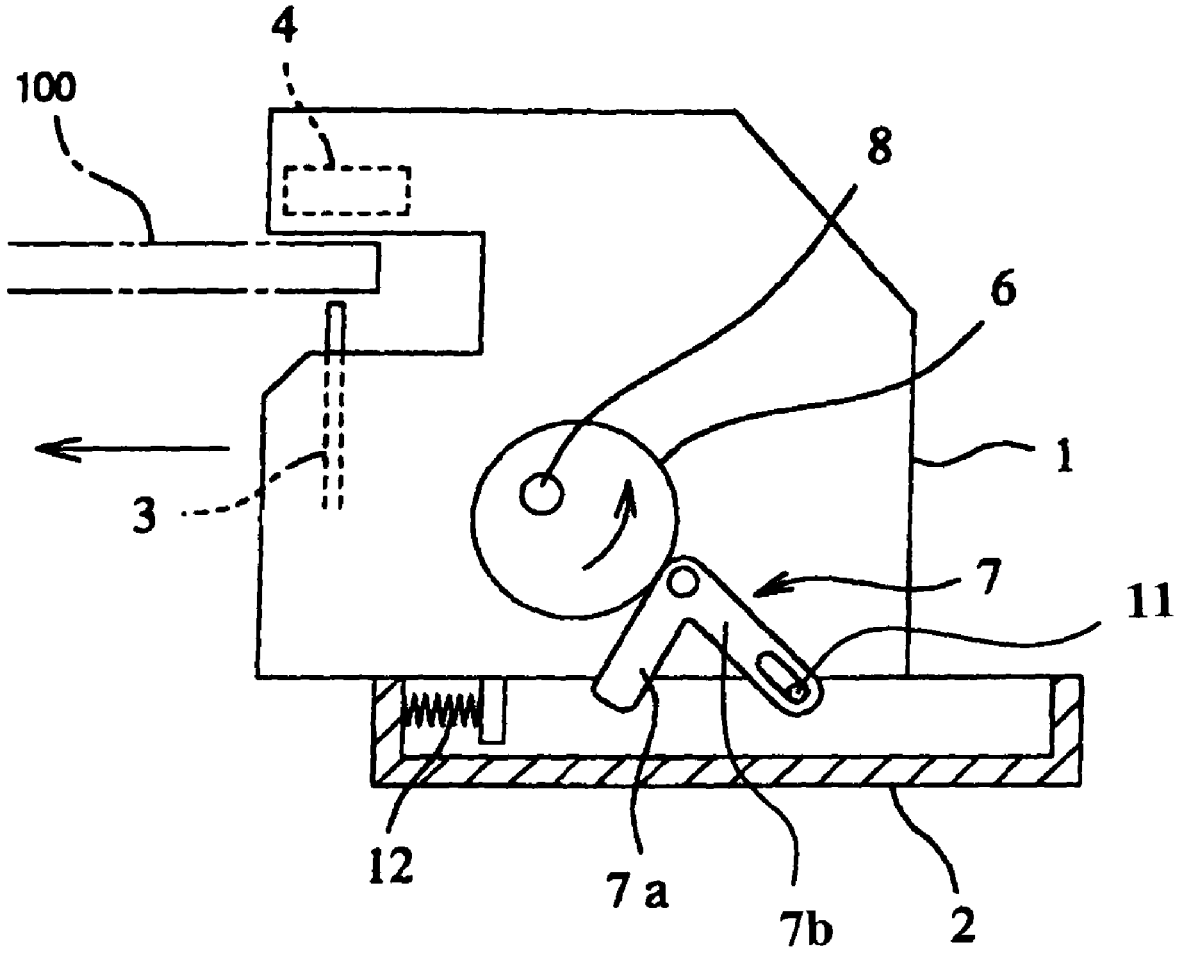
[FIG. 2] It is a schematic side view of an operating state of the stapler.

According to the above structure, as shown in FIG. 2, an end of the one portion 7*a* of the L-shaped link 7 engaging with the eccentric cam 6 is pressed counterclockwise in the figure by rotating the eccentric cam 6, so that an end of the other portion 7*b* acts so as to push the shaft 11 to the right direction in the figure, against a spring force of the compression spring 12. Consequently, if the base 2 is fixed to the image processing machine or the like, the stapler body 1 slides with respect to the base 2 to the left direction in the figure. Then, when it moves to a binding position of the bunch of papers 100 to be bound, the binding apparatus is operated so as to drive the driving means, thereby carrying out a binding operation. Since the L-shaped link 7 has no more force to push the shaft 11 when it passes a moving end, the spring force of the compression spring 12 becomes superior, and the stapler body 1 slides with respect to a body of the base 2 to an initial position.

It is preferable to provide an absorption mechanism with the eccentric cam 6 and the compression spring 12 so as to make a stroke constant.

When disposing a stapler having the above described structure inside an image processing machine such as a copying machine or a facsimile machine, and when the base 2 is fixed to a predetermined position of the image processing machine while the stapler body 1 moves with respect to the base 2, it can be set to slidable between the binding position (the position in FIG. 2) of the bunch of papers 100 subjected to an image processing in the image processing machine and a farthest position (the initial position, the position in FIG. 1) from the binding position. Further, the eccentric cam 6 can be set to rotate by a predetermined angle so that the link 7 moves the stapler body 1 to the binding position when the stapler stands ready for a binding after the image processing finishes, and to further rotate to an initial position after the binding operation.

According to the above-described structure, when the stapler stands ready for the binding so that the sliding mechanism 5 is operated by means of the drive mechanism of the stapler body 1 and the eccentric cam 6 rotates by the predetermined angle, the stapler body 1 slides to the binding position by a pressure from the eccentric cam 6 as shown in FIG. 2. The eccentric cam 6 stops at a moving end of the sliding movement, and then the binding apparatus is operated in the stapler body 1, thereby finishing the binding operation. Subsequently, when the eccentric cam 6 further rotates to the initial position as shown in FIG. 1, the stapler body 1 is retracted from the binding position by the spring force of the compression spring 12, and slides to the initial position. In this way, one binding cycle finishes.

As described above, with the base 2 being fixed to the image processing machine, it is possible to carry out a binding of the bunch of papers 100 by inserting and retracting the stapler body 1 with respect to the predetermined position (the binding position) of the image processing machine with the sliding mechanism 5, before and after the binding operation. Consequently, the size and the cost can be reduced in an image processing machine equipped with a paper conveying device, while it becomes possible to mount the stapler on an image processing machine equipped with no special apparatus for conveying the papers.

Also, since the base 2 is formed into a board shape having approximately the same size as the bottom surface of the stapler body 1, the stapler can be made compact as a whole.

Figure 3:
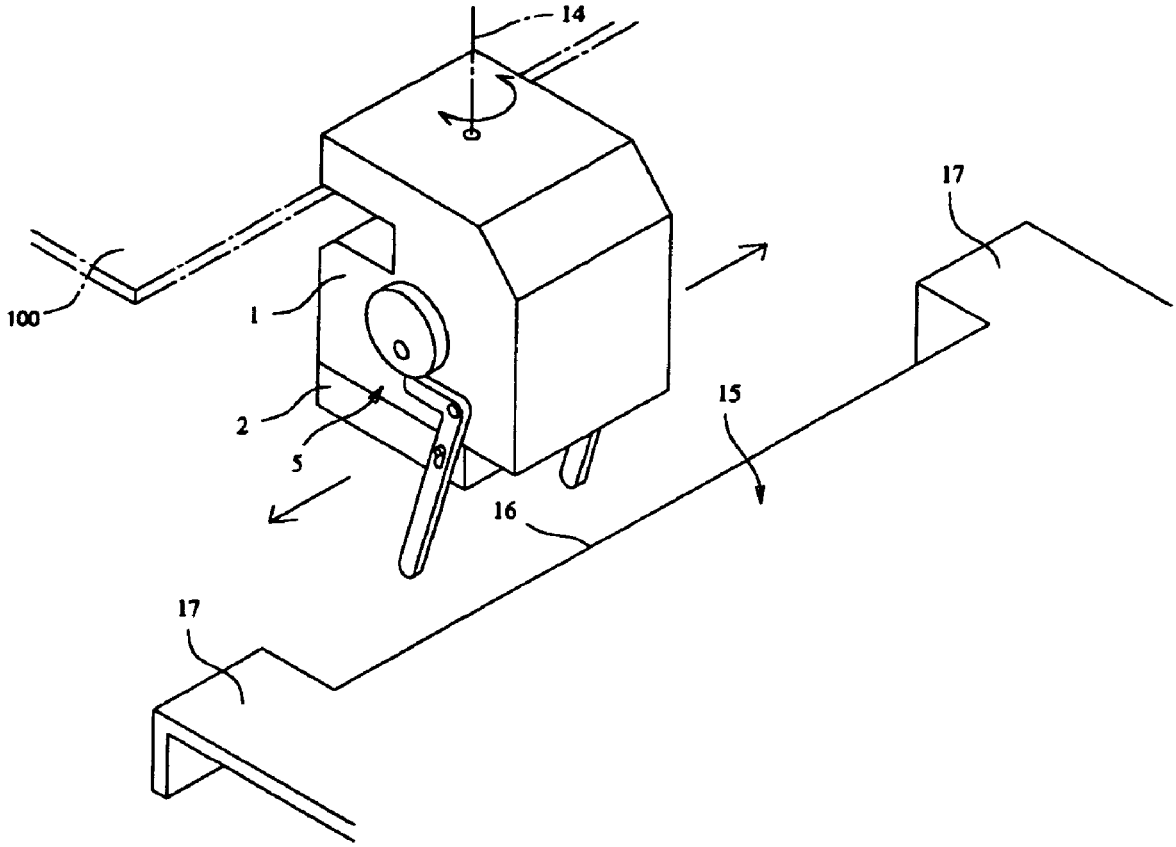
[FIG. 3] It is an explanatory diagram showing an application of the stapler.

Meanwhile, since the link is rotatably provided on each side of the stapler body 1 and the one end of each link is provided so as to be engagable with the base 2 in the above-described sliding mechanism, it is possible to obtain a stapler having a structure as shown in FIG. 3.

That is, although the stapler shown in FIG. 3 is the same as the above-described one in that it includes the base 2 and the stapler body 1, this stapler is rotatable about a central axis 14. The central axis 14 is perpendicular to a sliding surface of the stapler body 1. Further, a plate 15 is disposed at a rear side of the initial position of the stapler so as to correspond to a binding-side end face of the bunch of papers 100 to be bound. On the plate 15, projections 17 projecting in a forward direction from each end of a linear portion 16 are formed, the linear portion 16 being parallel to and longer than the binding-side end face of the bunch of papers 100 to be bound.

Here, driving means be provided for moving the stapler along an end edge of the plate 15.

Figure 4:
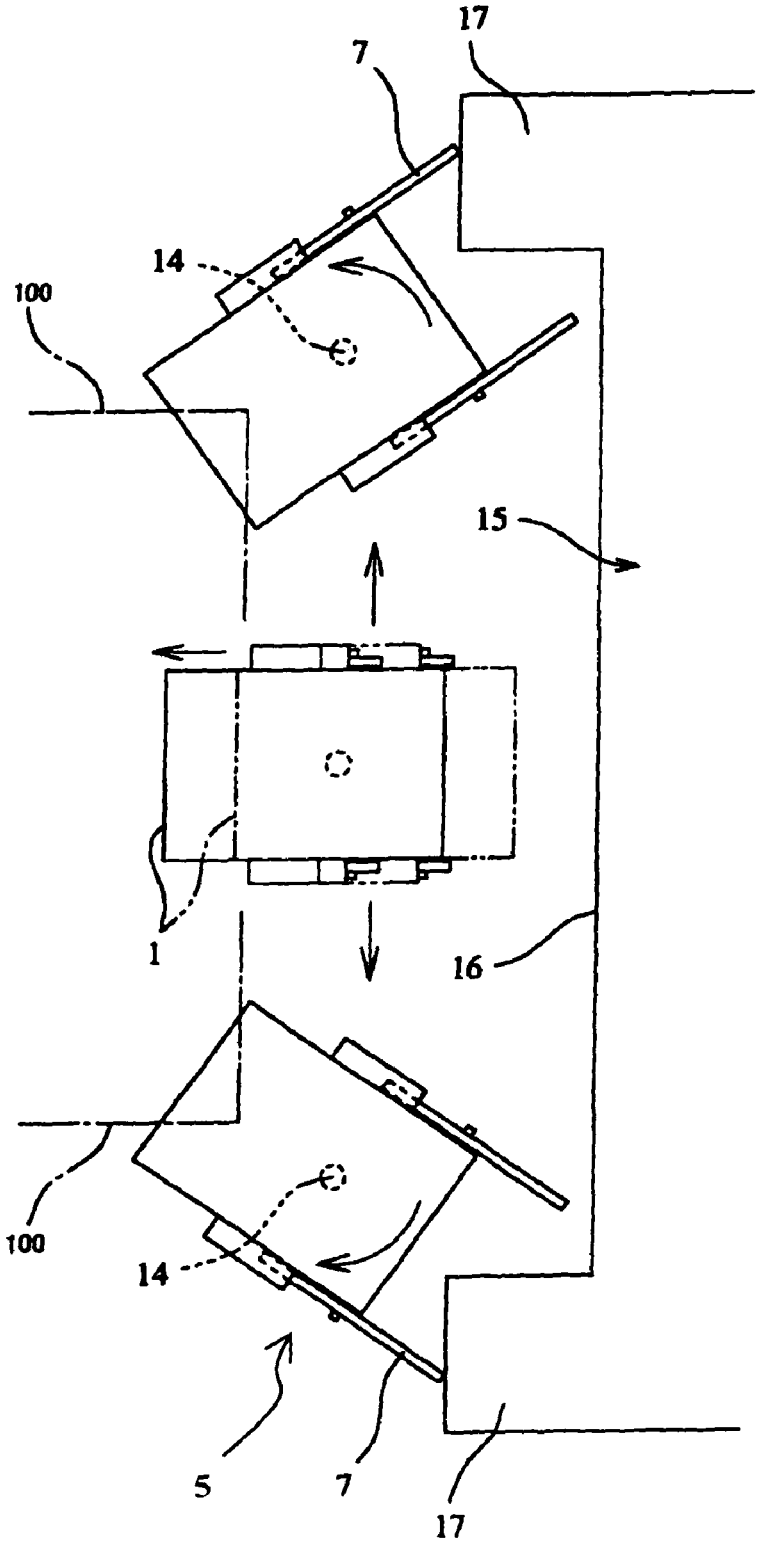
[FIG. 4] It is a plan view showing another example of the stapler.

According to the structure described above, as shown in FIG. 4, the sliding mechanism 5 of the stapler is operated on one end side of the linear portion 16 to slide the stapler body 1 so that a binding is carried out to the bunch of papers 100, after that, the stapler body 1 returns back to the initial position, and further, the driving means moves the stapler body 1 to the other end side of the linear portion 16 to carry out a binding at another position of the bunch of papers 100 by operating the sliding mechanism 5 once again. In this way, two or three parts of the bunch of papers 100 can be stapled along a straight line.

Also, when the stapler body 1 is moved to one of the projections 17 of the plate 15 and the sliding mechanism 5 is operated, one of the L-shaped links 7 on either side of the stapler body 1 abuts against the projection 17 when it rotates, and presses the projection 17 when the L-shaped links 7 rotates further. However, since the projection 17 does not move, the stapler body 1 rotates about the central axis 14 by a certain angle together with the base 2. Along with the rotation of the certain angle, the stapler body 1 slides with respect to the base 2, thereby carrying out a binding. Thus, a corner binding is possible with respect to the bunch of papers 100. As the L-shaped link 7 has no more pressure against the projection 17 after the binding operation, it is preferable to attach a spring (not shown) for rotating the base 2 to an original position.

Also, when the stapler body 1 is moved to one of the projections 17 of the plate 15 and the sliding mechanism 5 is operated, one of the L-shaped links 7 on either side of the stapler body 1 abuts against the projection 17 when it rotates, and presses the projection 17 when the L-shaped links 7 rotates further. However, since the projection 17 does not move, the stapler body 1 rotates about the central axis 14 by a certain angle together with the base 2. Along with the rotation of the certain angle, the stapler body 1 slides with respect to the base 2, thereby carrying out a binding. Thus, a corner binding is possible with respect to the paper 100. As the L-shaped link 7 has no more pressure against the projection 17 after the binding operation, it is preferable to attach a spring (not shown) for rotating the base 2 to an original position.

Figure 5:
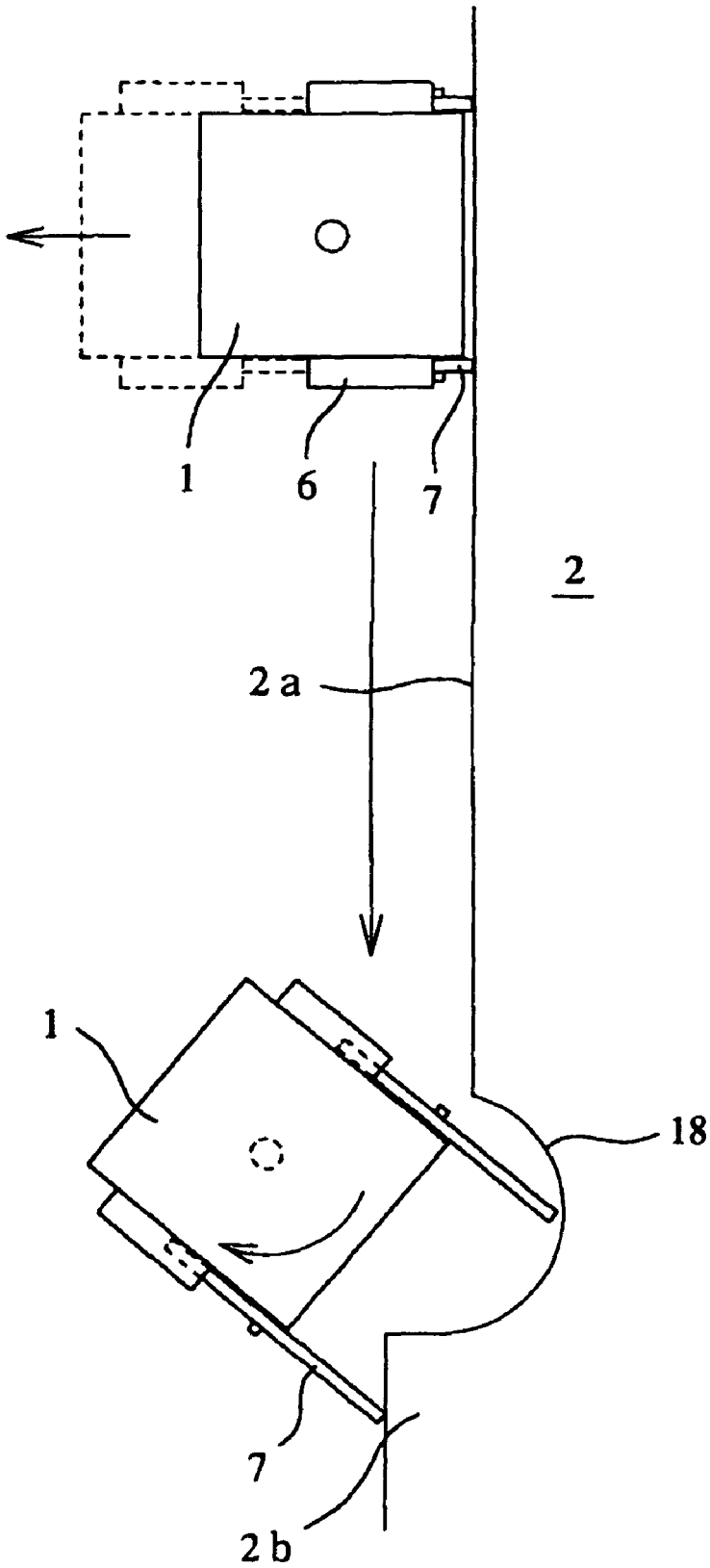
[FIG. 5] It is a plan view showing still another example of the stapler.

Next, in FIG. 5, the base 2 and the stapler body 1 are provided separately, the eccentric cam 6 and the L-shaped link 7 are attached to the stapler body 1 as described above, and a linear portion 2*a* and a projection 2*b* is formed on the base 2. Reference numeral 18 indicates a relief portion.

Figure 6A:
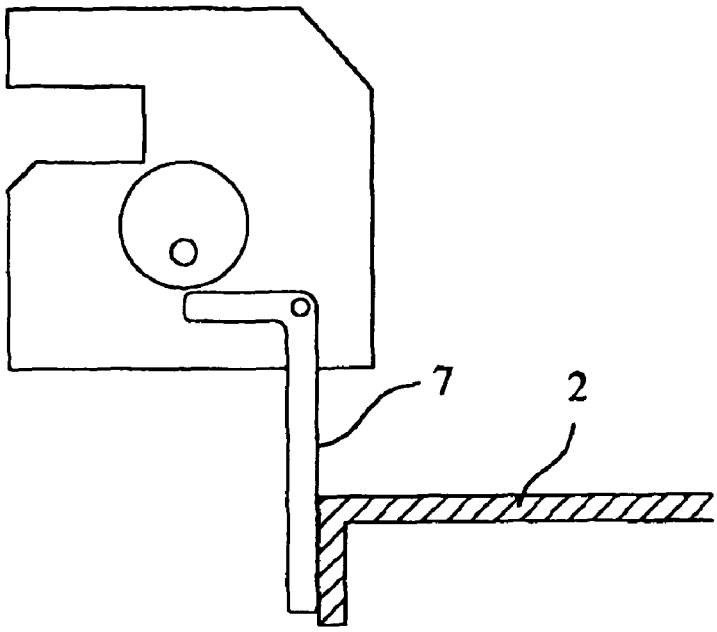
[FIG. 6A] It is a plan view of the stapler, showing the stapler in an original position.
Figure 6B:
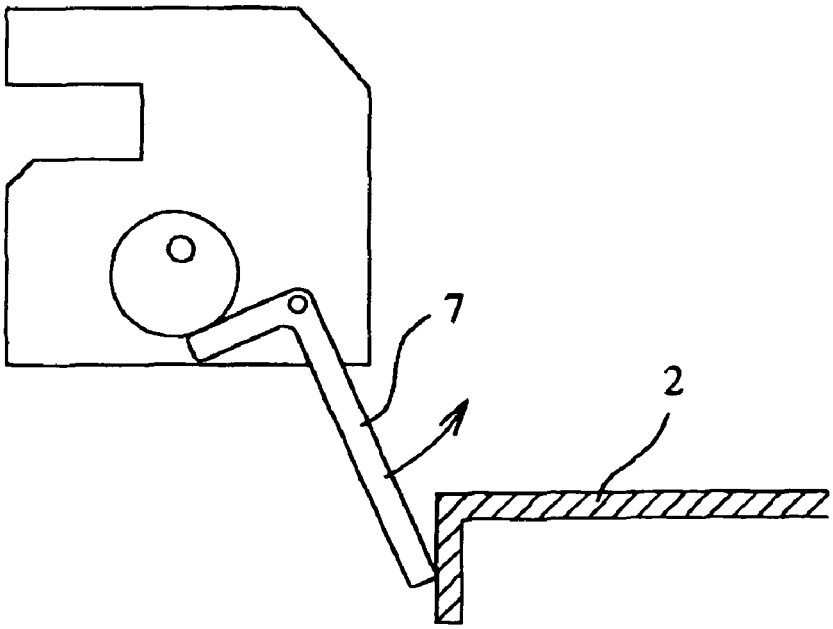
[FIG. 6B] It is a plan view of the stapler, showing the stapler in a binding position.

According to the structure described above, when the sliding mechanism 5 of the stapler is operated on one end side of the linear portion 2*a* and the right and left L-shaped links 7 is rotated, one end of each of the L-shaped links 7 pushes the linear portion 2*a* of the base 2 so that the stapler body 1 slides as shown in FIGS. 6A and 6B, thereby carrying out a binding with respect to the bunch of papers 100. Subsequently, the stapler body 1 returns again to the initial position, a driving means moves the stapler body 1 to the other end side of the linear portion 2*a*, and the sliding mechanism 5 is operated again, thereby carrying out a binding at another position of the bunch of papers 100. In this way, the bunch of papers 100 can be stapled with a plurality of staples along a straight line.

Further, when the stapler body 1 is moved to the projection 2*b* of the base 2 and the sliding mechanism 5 is operated, one of the L-shaped links 7 on either sides of the stapler body 1 abuts against the projection 2*b* when it rotates, and presses the projection 2*b* when it rotates further. However, since the projection 2*b* does not move, the stapler body 1 rotates. The stapler body 1 rotates by a certain angle, and then slides to carry out a binding. Thus, a corner binding is possible with respect to the bunch of papers 100. In this case as well, since the L-shaped link 7 has no more pressure against the projection 2*b* after the binding operation, it is preferable to attach a spring (not shown) for rotating the base 2 to the original position.

As described heretofore, since the L-shaped link 7 is rotatably provided on each side of the stapler body 1 and one end of the L-shaped link 7 is provided so as to be engagable with the base 2 in the sliding mechanism 5, the stapler can be applied in a variety of ways using the operation of the L-shaped link 7.

Although the invention has been described in detail and with reference to the specific embodiment, it is obvious to those skilled in the art that various changes and modifications can be added thereto without departing from the spirit and scope of the invention.

The present application is based on the Japanese patent application (Patent Application No. 2004-115932) filed on Apr. 9, 2004, the contents thereof are incorporated herein by reference.

INDUSTRIAL APPLICABILITY

According to the embodiment of the invention, it becomes possible to reduce the size and cost of an image processing machine equipped with a paper conveying device, while it becomes possible to mount the stapler on an image processing machine equipped with no special apparatus for conveying paper. Further, since the sliding mechanism is configured such that one end of the link, which is rotatably provided on each side of the stapler body, is provided so as to be engagable with the base, the stapler can be applied in a variety of ways using the operation of the link.

The invention claimed is:

1. A self-propelled stapler mounted on an image processing machine, the self-propelled stapler comprising:

a base fixed to the image processing machine;

a stapler body which is slidable with respect to the base; and a sliding mechanism which is provided between the base and the stapler body, wherein the sliding mechanism comprises a link which is rotatably provided on the stapler body, and is engagable with the base, wherein the link is rotated by a drive mechanism inside the stapler body to slide the stapler body with respect to the base such that the stapler body slides to a predetermined binding position at the time of a binding operation, and slides to an original position after the binding operation, wherein the drive mechanism is attached to the stapler body such that the drive mechanism slides with respect to the base when the stapler body slides with respect to the base, and wherein the sliding mechanism further comprises:

a disk-shaped eccentric cam having a rotary shaft at an eccentric position, and a spring provided between the base and the stapler body, wherein the link is an L-shaped link having a rotatably supported bent portion, one portion of the L-shaped link is engaged with an outer circumferential face of the eccentric cam, an elongated hole is formed in another portion of the L-shaped link, the elongated hole is engaged with a shaft provided on a corresponding side of the base, and the drive mechanism inside the stapler body rotates the eccentric cam so that the L-shaped link is rotated to slide the stapler body to the binding position against the spring.

2. The self-propelled stapler according to claim 1, further comprising a central axis which is perpendicular to a sliding surface of the stapler body, wherein the stapler body is rotatable about the central axis together with the base.

3. The self-propelled stapler according to claim 1, further comprising a second disk-shaped eccentric cam and a second L-shaped link, wherein one of the disk-shaped eccentric cams and one of the L-shaped links are arranged on one side of the stapler body, and the other of the disk-shaped eccentric cams and the other of the L-shaped links are arranged on another side of the stapler body.

4. A self-propelled stapler, the stapler being mounted in an image processing machine to bind image-processed papers inside the image processing machine, wherein a stapler body is provided on a base so as to be relatively slidable with respect to the base, a sliding mechanism is provided between the base and the stapler body, the base is fixed to the image processing machine, and the sliding mechanism slides the stapler body to a predetermined binding position at the time of a binding operation, and slides the stapler body to an original position after the binding operation, the sliding mechanism is configured such that:

a disk-shaped eccentric cam, having a rotary shaft at an eccentric position, and an L-shaped link, having a rotatably supported bent position, are arranged on each side of the stapler body, one portion of the L-shaped link is engaged with an outer circumferential face of the eccentric cam, an elongated hole formed in another portion of the L-shaped link is engaged with a shaft provided on a corresponding side of the base, and a spring is provided between the base and the stapler body, wherein a drive mechanism inside the stapler body rotates the eccentric cam so that the L-shaped link is rotated to slide the stapler body to the binding position against the spring.

* * * * *